US006107903A

United States Patent [19]

Sako et al.

[11] Patent Number: 6,107,903

[45] Date of Patent: Aug. 22, 2000

[54] ELECTROMAGNETIC RELAY

[75] Inventors: Kazumi Sako; Yoichi Nakanishi; Ryutaro Tsuchiya; Yuichi Kariya, all of Kyoto, Japan

[73] Assignee: Omron Corporation, Japan

[21] Appl. No.: 09/036,384

[22] Filed: Mar. 6, 1998

[30] Foreign Application Priority Data

Mar. 7, 1997 [JP] Japan ..... 9-053082

[51] Int. Cl.[7] ..... H01H 51/22; H01H 13/00

[52] U.S. Cl. ..... 335/78; 335/202

[58] Field of Search ..... 335/78–86, 124, 335/128, 202

[56] References Cited

U.S. PATENT DOCUMENTS

| | | | |
|---|---|---|---|
| 4,665,375 | 5/1987 | Weiser | 335/78 |
| 4,975,666 | 12/1990 | Nobutoki | 335/78 |
| 5,357,230 | 10/1994 | Mikawa | 335/78 |
| 5,608,366 | 3/1997 | Sako | 335/78 |

FOREIGN PATENT DOCUMENTS

| | | |
|---|---|---|
| 0 197 391 | 3/1986 | European Pat. Off. . |
| 0 192 928 | 8/1986 | European Pat. Off. . |
| 0 727 803 | 8/1996 | European Pat. Off. . |
| 39 35 351 | 4/1991 | Germany . |

OTHER PUBLICATIONS

European Search Report dated Jul. 8, 1998.

*Primary Examiner*—Michael L. Gellner
*Assistant Examiner*—Raymond Barrera
*Attorney, Agent, or Firm*—Morrison & Foerster

[57] ABSTRACT

An object of this invention is to provide an electromagnetic relay with better isolation characteristics. The invention discloses an isolation wall and an isolation rib in an electromagnetic relay for separating a movable iron member from a movable contact member to provide better isolation characteristics.

3 Claims, 15 Drawing Sheets

ELECTROMAGNETIC RELAY

FIELD OF THE INVENTION

This invention generally relates to electromagnetic relays and, more particularly, to a structure for providing electrical isolation in an electromagnetic relay.

BACKGROUND OF THE INVENTION

An example of a prior art electromagnetic relay can be found in Japanese Patent Publication 61-218027 illustrated in FIG. 14.

In this electromagnetic relay, movable armature block 105 is supported by way of permanent magnet 104 on the upper surface of coil block 103 in a way that it is free to rotate. In the armature block 105, movable contact springs 152 are on either side of contact element 151. These contact springs 152 are formed integrally with crosspiece 153 from a composite resin material. In a polarized relay like this electromagnetic relay, contact element 151 is separated from movable contact springs 152 by a set of partitions 116 which come down from the ceiling of case 112. This is done to increase the isolation between contact element 151 and movable contact springs 152.

A drawback of the above electromagnetic relay, however, is that there can be spaces between the lower ends of partitions 116 and crosspiece 153, and spaces between the side ends of partitions 116 and the interior wall of case 112. This causes the isolation distance between the contact element 151 and movable contact springs 152 to be short, which results in poor isolation characteristics. In recent years, there has been an increase in demand for smaller and smaller electromagnetic relays, but the smaller the relay becomes, the poorer its isolation characteristics. Accordingly, there exists a need for a structure that provides adequate electrical isolation in electromagnetic relays.

SUMMARY OF THE INVENTION

In view of the drawbacks described above, an objective of the invention is to provide an electromagnetic relay with excellent electrical isolation characteristics.

The electromagnetic relay according to this invention has an electromagnetic block, a base block where the electromagnetic block is fixed, and a movable block having a movable iron member and a movable contact member. The electromagnetic relay is characterized by a configuration where the base block further comprises an L-shaped wall protruded upwardly to have wider and longer electromagnetic isolation between the movable iron member and the movable contact member, resulting in good isolation characteristics.

This invention is further characterized by a configuration where a cover has an isolation rib which comes to contact with the isolation walls for better isolation.

The above features and advantages of the invention will be better understood from the following detailed description of the invention taken into conjunction with the accompanying drawings.

BRIEF DESCRIPTION OF THE DRAWINGS

FIG. 3(*b*) is a frontal cross section of the electromagnetic relay of FIG. 1; and FIG. 3(*c*) is a partial cross section of the electromagnetic relay of FIG. 1 taken across line A—A of FIG. 3(*b*).

FIG. 5(*b*) is a perspective drawing of the core with the spool formed on it as viewed from below.

FIG. 6(*b*) is a perspective drawing of the electromagnetic block as viewed from below.

FIGS. 8(*b*) and (*c*) are magnified plan views of key components of the electromagnetic block.

FIG. 9(*b*) is a frontal view showing how the electromagnetic block is molded in the secondary process.

FIG. 10(*b*) is a perspective drawing of the movable block as seen from below before it is resin-molded.

FIG. 12(*b*) is a plan view of another embodiment of the base block.

DETAILED DESCRIPTION OF THE INVENTION

Figure 1:
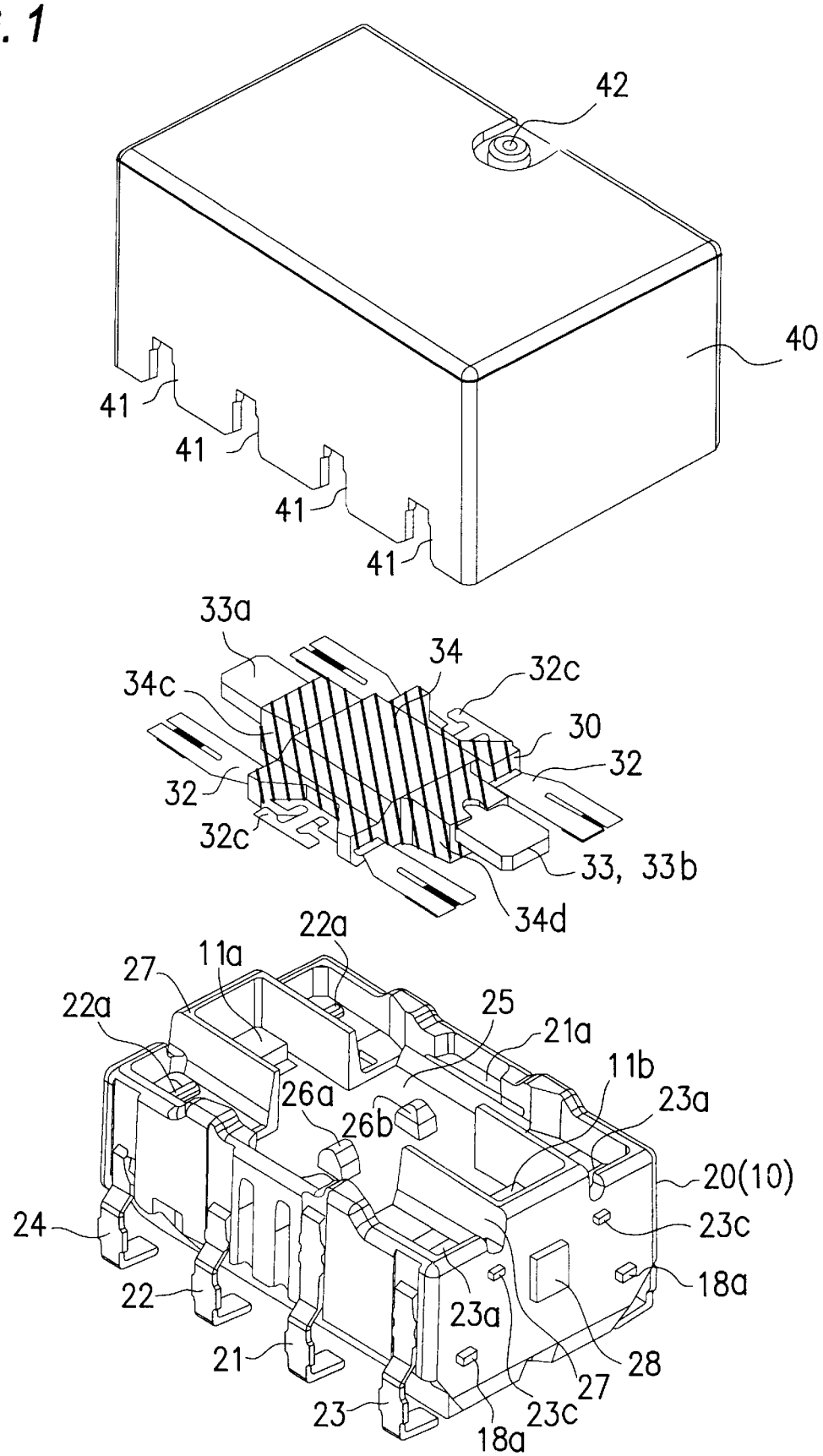
FIG. 1 is an exploded perspective drawing of an electromagnetic relay in a first ideal embodiment of this invention.

Detailed description of an ideal embodiment of this invention will now be discussed with reference to FIGS. 1 through 13.

An electromagnetic relay of this invention primarily comprises a base block 20 which is formed by performing a secondary molding process on an electromagnetic block 10, a movable block 30 and a case 40. The exterior dimensions of the electromagnetic relay of this embodiment (W×L×H) are 10 mm×6.6 mm×5 mm.

Figure 3A:
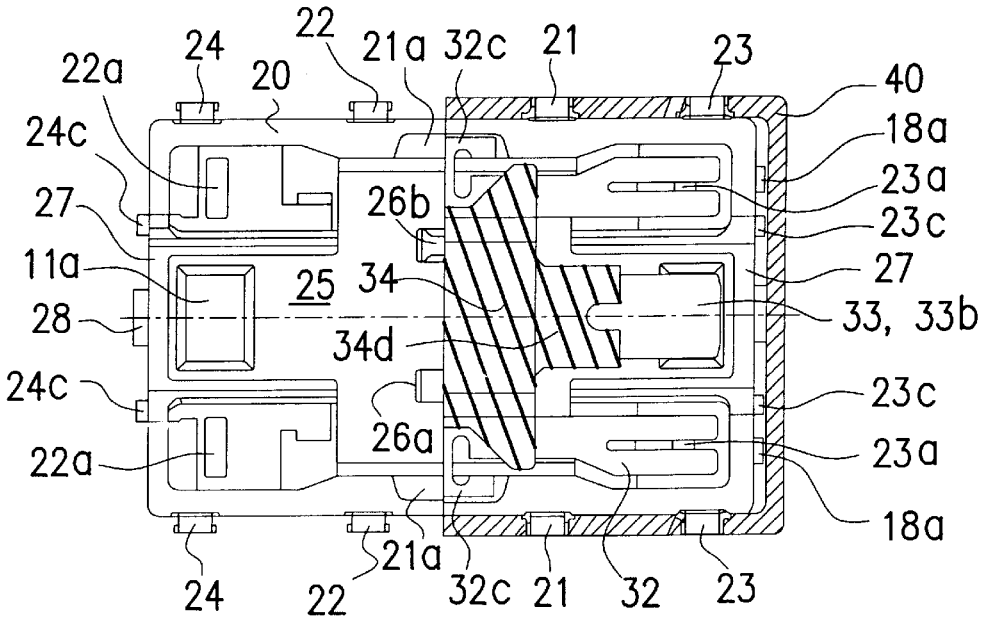
FIG. 3(*a*) shows a planar cross section of the electromagnetic relay of FIG. 1 after assembly.
Figure 3B:
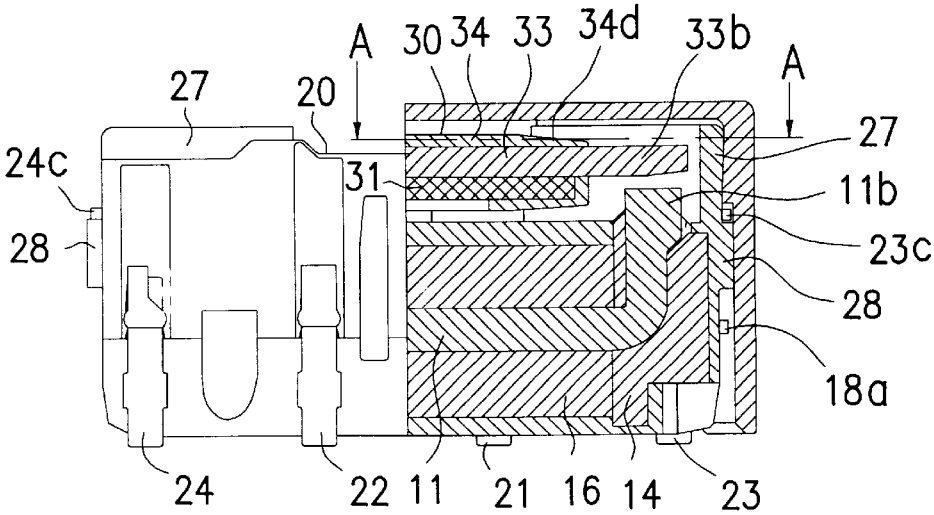
Figure 3C:
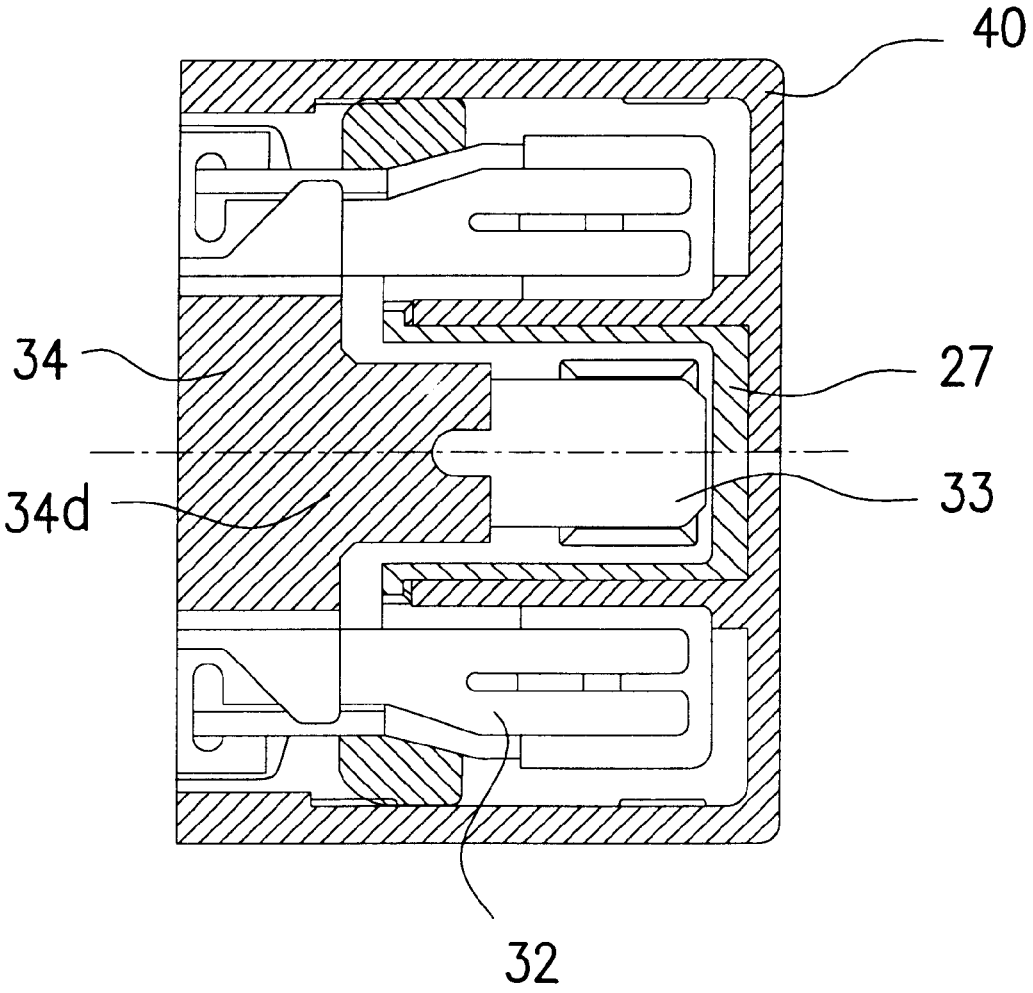

In the electromagnetic block 10, as illustrated in FIGS. 3(*b*) and 4, coil 16 is wrapped around core 11, which is shaped like a "C".

Figure 5A:
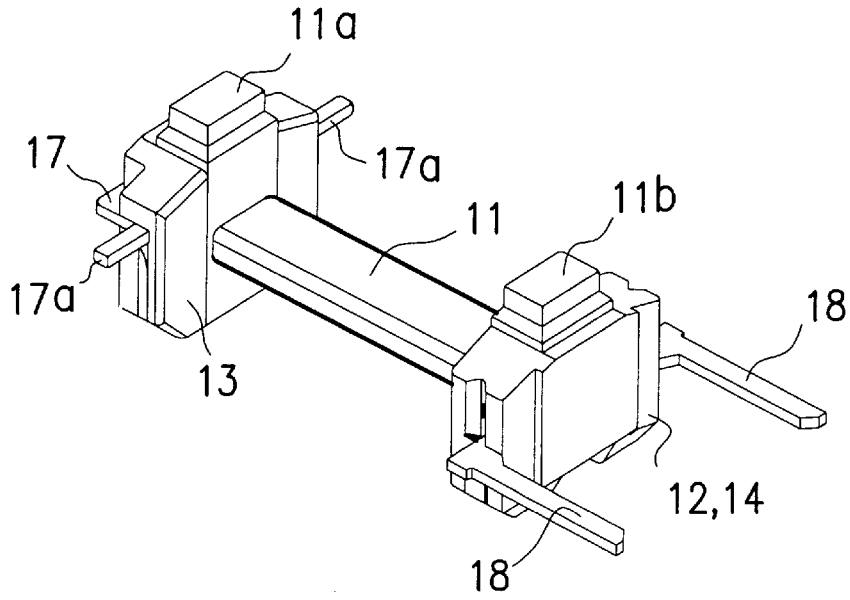
FIG. 5(*a*) is a perspective drawing of the core with the spool formed on it as viewed from above.
Figure 5B:
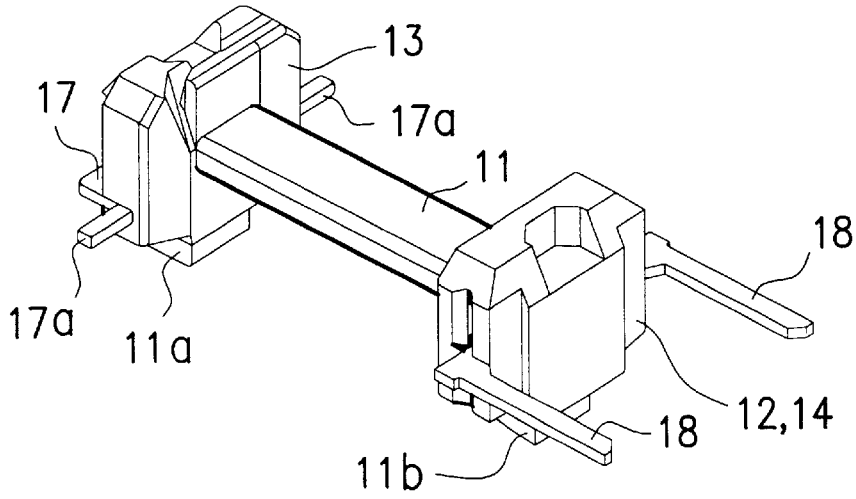
Figure 6A:
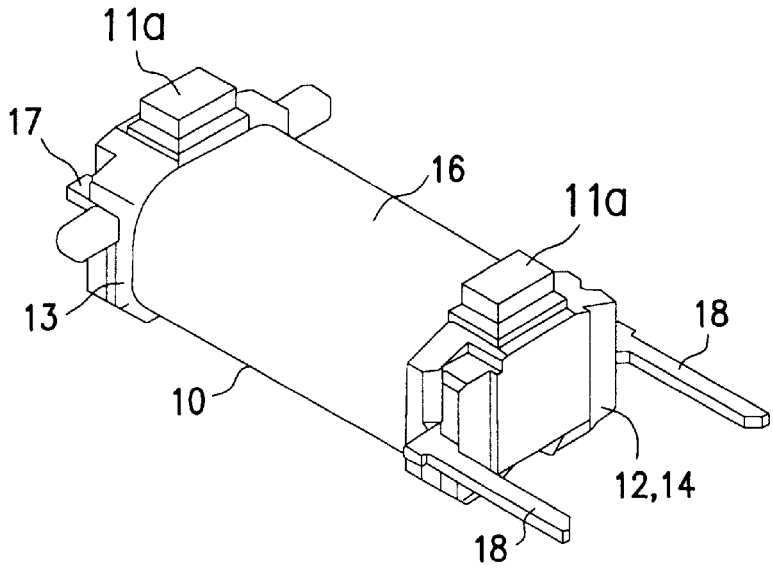
FIG. 6(*a*) is a perspective drawing of the electromagnetic block as viewed from above.
Figure 6B:
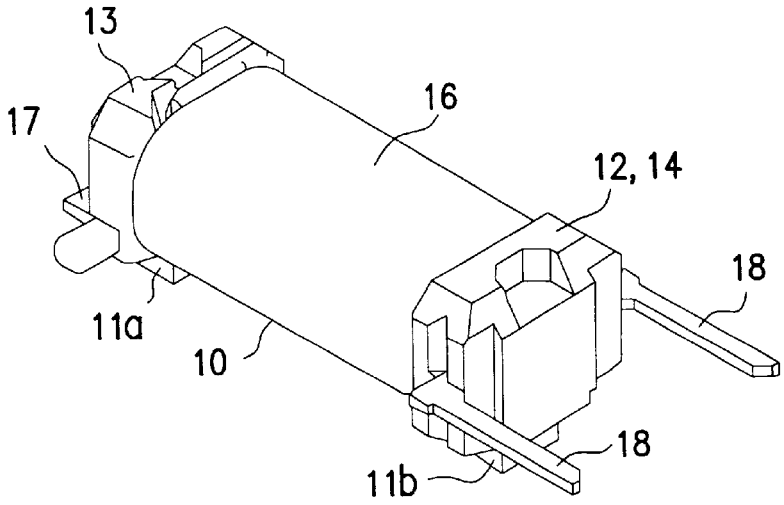

To construct the electromagnetic block 10, as illustrated in FIGS. 5(*a*) and 5(*b*), a primary molding process is applied on C-shaped core 11 to form spool 12. Flanges 13 and 14 are formed on either end of core 11 to form the spool. From either side of the flange 14 extend two connector elements 18.

Coil 16 is wrapped around the center portion of the core 11. The wire which is drawn out is tied and soldered to post 17a on lug terminal strip 17, which is insert-molded onto flange 13 (see FIG. 6).

Figure 7:
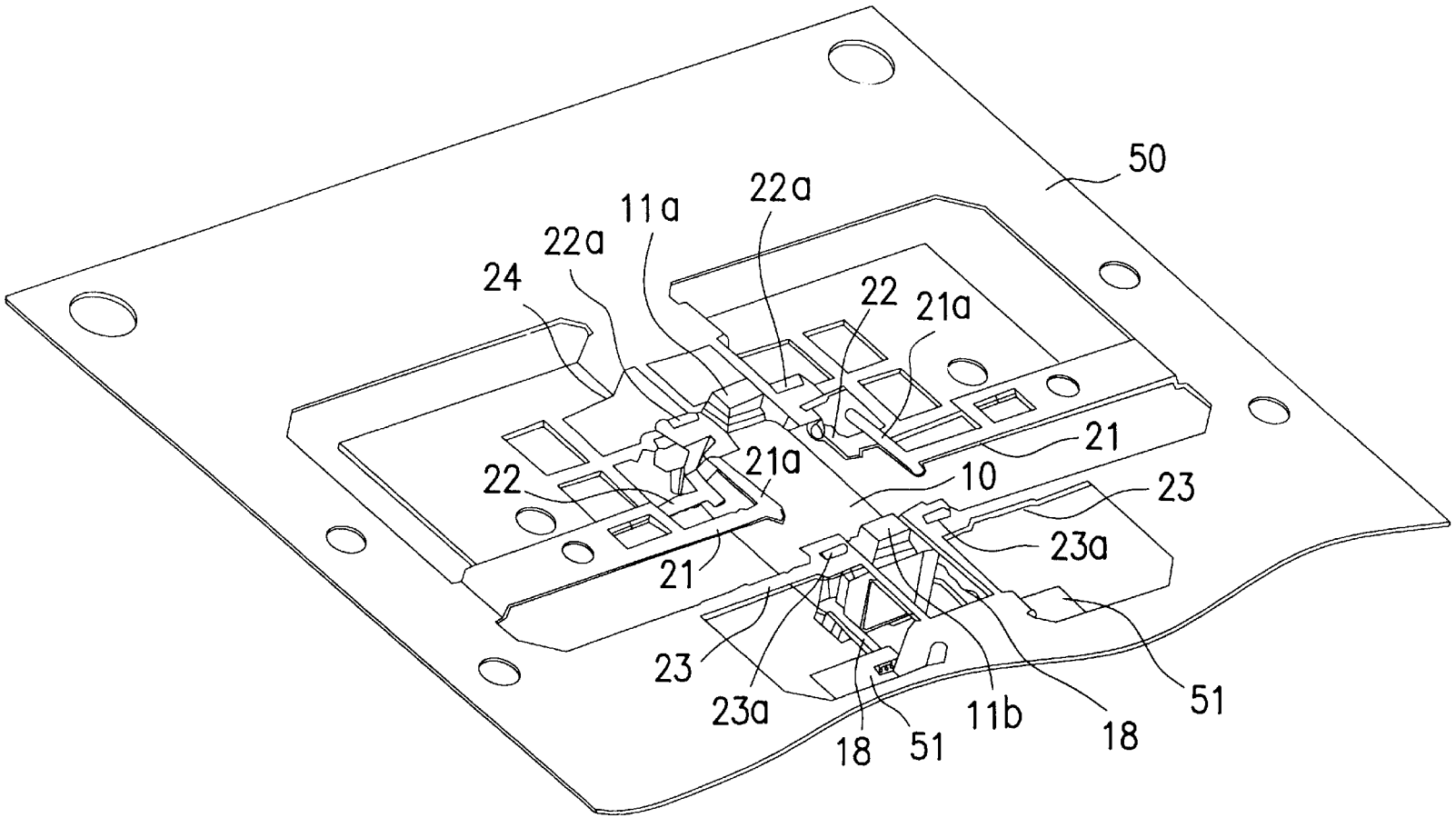
FIG. 7 is a perspective drawing showing the secondary molding process executed on the electromagnetic block.
Figure 8A:
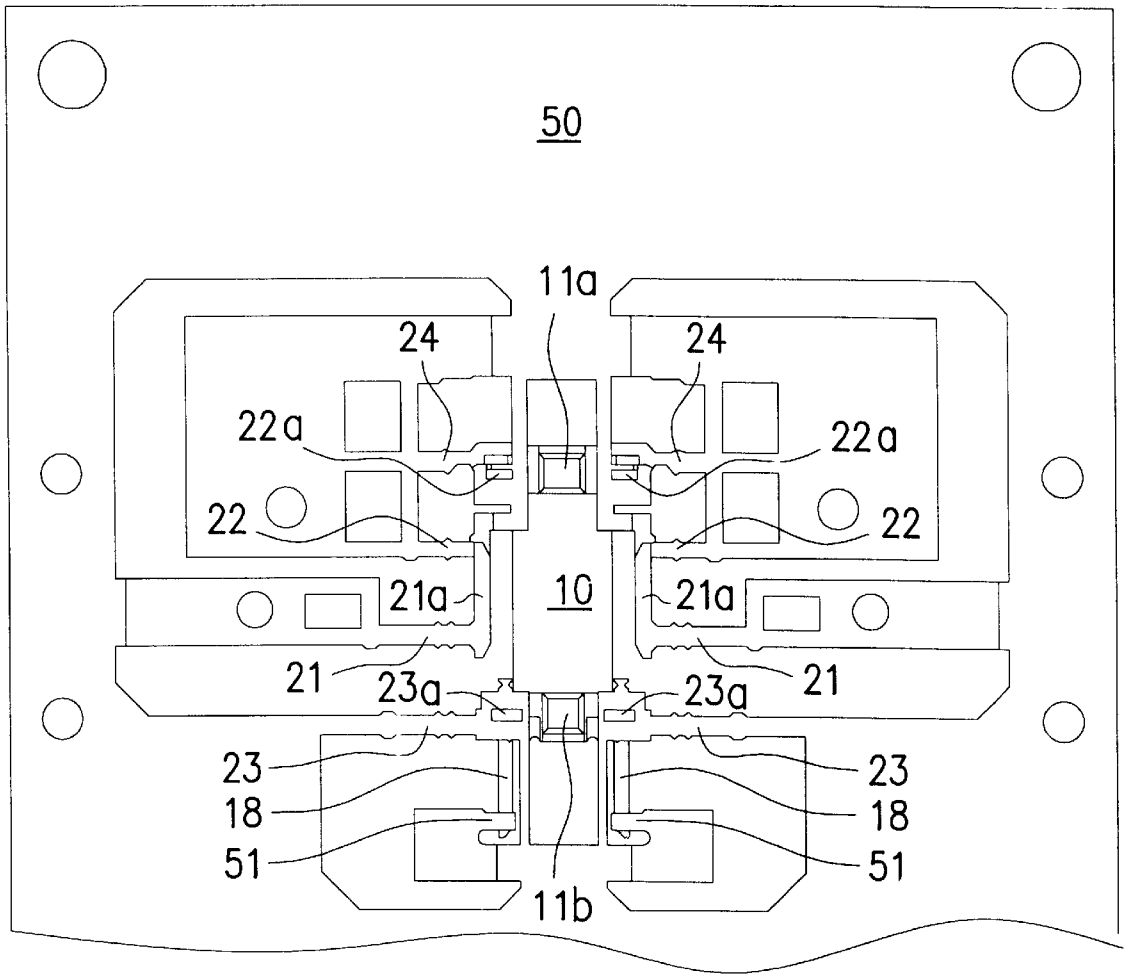
FIG. 8(*a*) is a plan view showing how the electromagnetic block is molded in the secondary process.
Figure 8B:
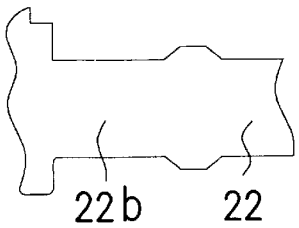
Figure 8C:
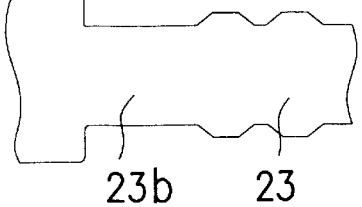
Figure 9A:
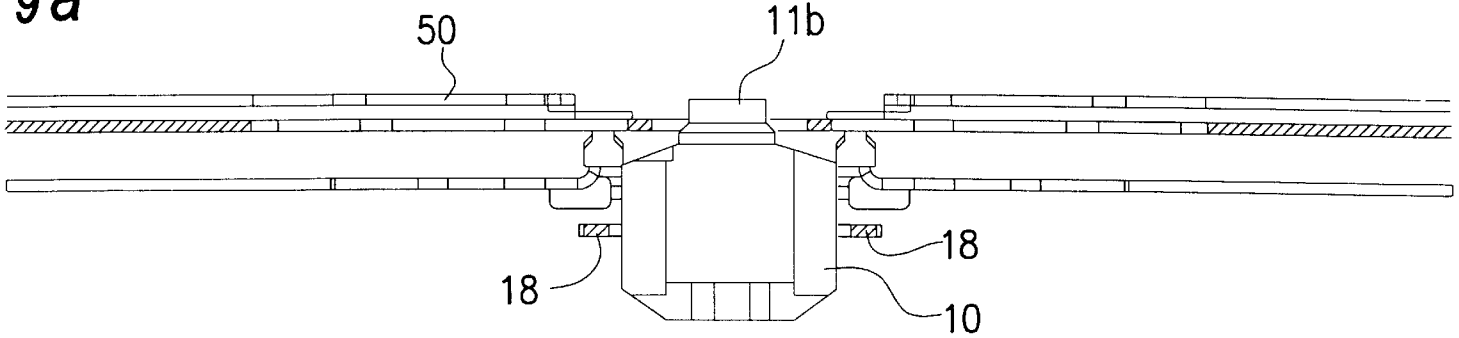
FIG. 9(*a*) is a lateral view showing how the electromagnetic block is molded in the secondary process.
Figure 9B:
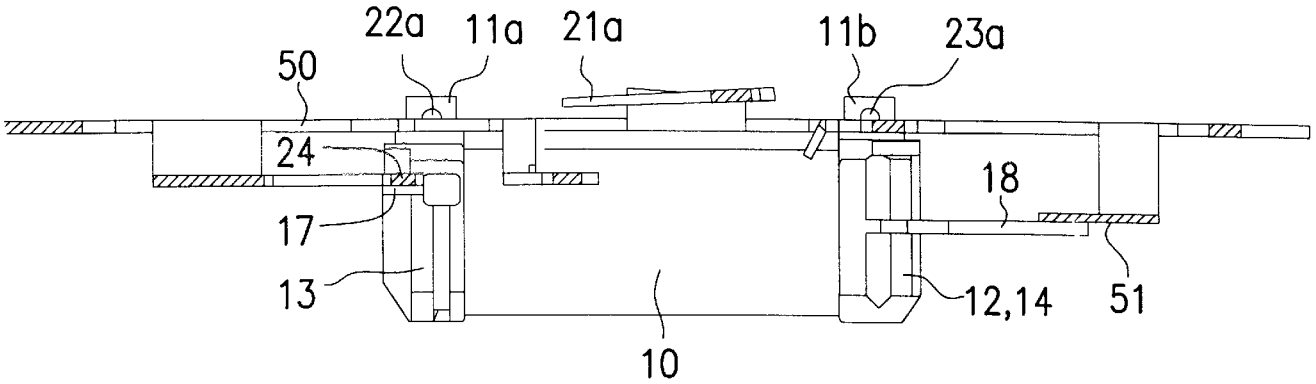

Base block 20, as illustrated in FIGS. 7–9, is formed by applying a secondary molding process on the electromagnetic block 10, which is connected to lead frame 50. Common terminals 21, fixed contact terminals 22 and 23 and coil terminals 24 are formed by cutting out portions of the lead frame 50. Support 51 is also formed this way. Fixed contacts 22*a* and 23*a* are mounted on the fixed contact terminals 22 and 23, respectively.

Connecting terminals 17 on electromagnetic block 10 are welded to the free ends of coil terminal 24; and the connector elements 18 are welded to support 51 on lead frame 50. All these components are positioned properly in a mold and a secondary molding process is applied. Connector elements 18 are then cut away from the lead frame 50. Terminals 21 through 24 are formed by cutting and bending the frame, completing the formation of the base block 20. Finally, the base of each terminal 21 through 24 is made flush with the exterior surface of the base block 20.

As illustrated in FIGS. 8(*b*) and 8(*c*), terminals 21 through 24, which protrude from the sides of base block 20, each have a narrow portion (21*b* through 24*b*) on their base (21*b* and 224*b* are not shown). When terminals 21 through 24 are bent downward, they bend at this narrow portion. Thus, a specified height can be achieved accurately even without the use of a mold to form a standard surface and, as such, there is no variation in the location of the bend. Terminals 21 through 24 fit into shallow grooves in base block 20, so their exterior surfaces are virtually flush with the surface of the base block 20.

If the terminals 21 through 24 are, for example, 0.15 mm thick, then the distance from the side of base block 20 before the terminals are bent to narrow portions 21*b* through 24*b* should be between 0 and 0.05 mm.

Referring back to FIG. 1, the base block 20 is produced by a secondary molding process, and has a shallow depressed area 25 on its upper surface. In the center of depressed area 25 are two small bosses, 26*a* and 26*b*. One of these bosses, 26*a*, has a long top ridge line along its apex which will make linear contact with movable block 30, as will be discussed next. The other boss, 26*b*, has a shorter top ridge line along its apex in order to absorb any variation in the accuracy of the width dimension.

Fixed contacts 22*a* and 23*a* on terminals 22 and 23, respectively, are exposed in the corners of the depressed area 25. Magnetic pole 11*a* of core 11 is exposed between the two adjacent terminals 22*a* on one side of area 25, and magnetic pole 11*b* is exposed between terminals 23*b* on the other side. Poles 11*a* and 11*b* of core 11 are segregated from fixed contact terminals 22*a* and 23*a* by wall 27, which is shaped like an angular letter C when seen from above. The outer sides of the wall 27 which are opposite to the facing sides is tapered (see FIG. 4). Connector elements 21*a* of common terminals 21 protrude from the corners formed in the middle of the cut-away side of the base block 20.

Figure 2:
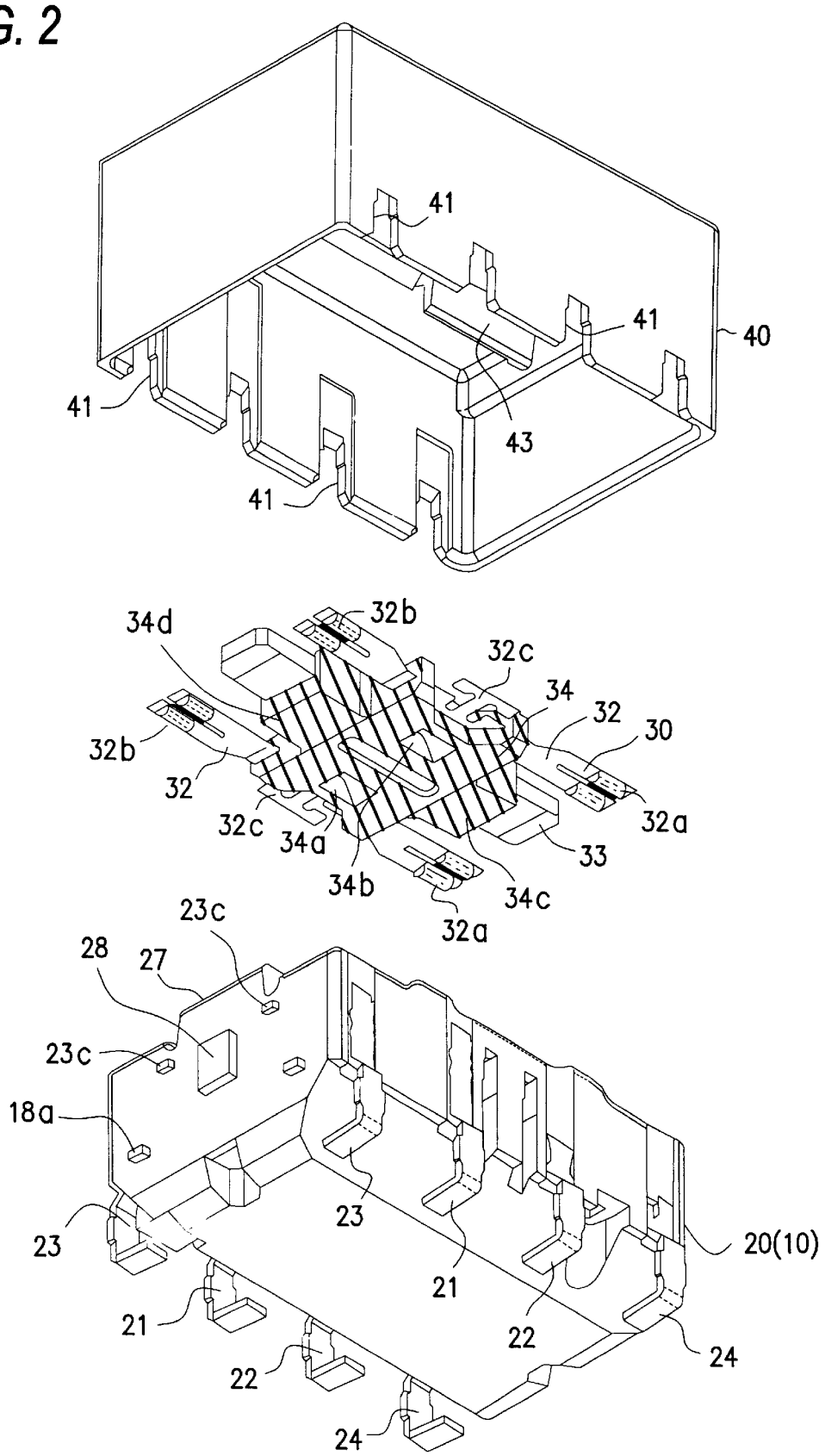
FIG. 2 is an exploded perspective drawing of the electromagnetic relay of FIG. 1 as seen from below.

Referring to FIGS. 1 and 2, there is a projection 28 on either end of the base block 20 in the middle of the end surface. Referring next to FIG. 3(*b*), projections 28 protrude further than connector elements 18, fixed contact terminals 23 and end portions 18*a*, 23*c* and 24*c*. This is to prevent end portions 23*c* and 24*c* from getting caught or hung up on each other when base blocks 20 are continuously conveyed.

Figure 12A:
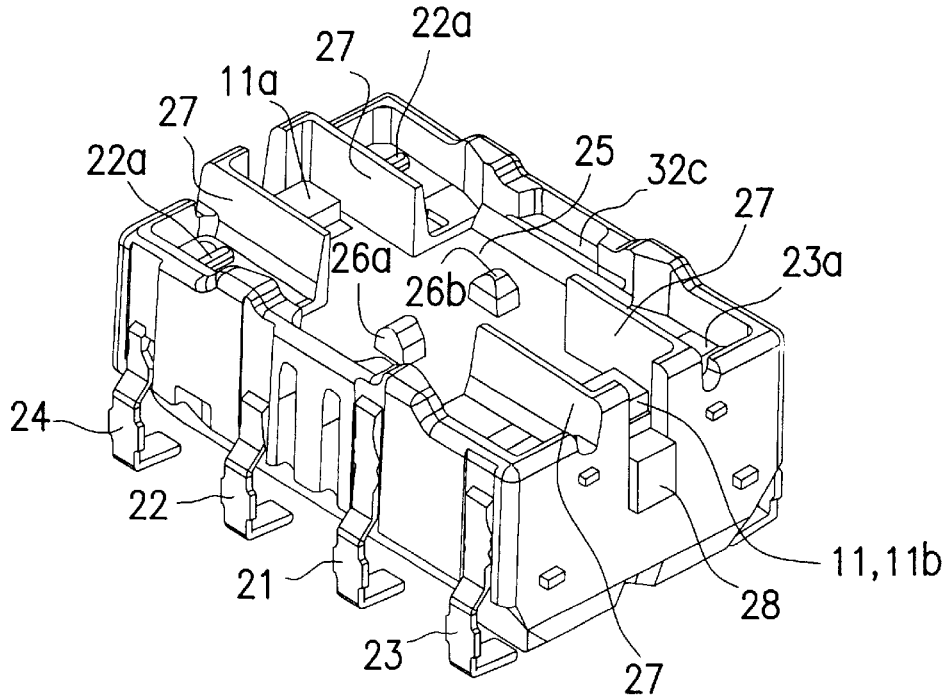
FIG. 12(*a*) is a perspective drawing of another embodiment of the base block.
Figure 12B:
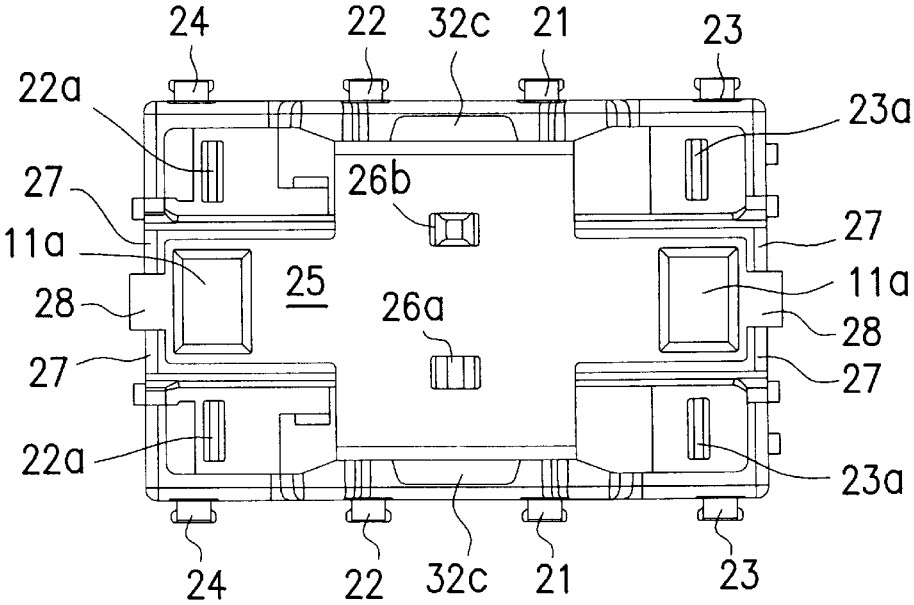

The configuration of base block 20, however, is not limited to that described above. Base block 20 could have a configuration of four separate L-shaped walls 27, as illustrated in FIG. 12, for providing electrical isolation.

Figure 10A:
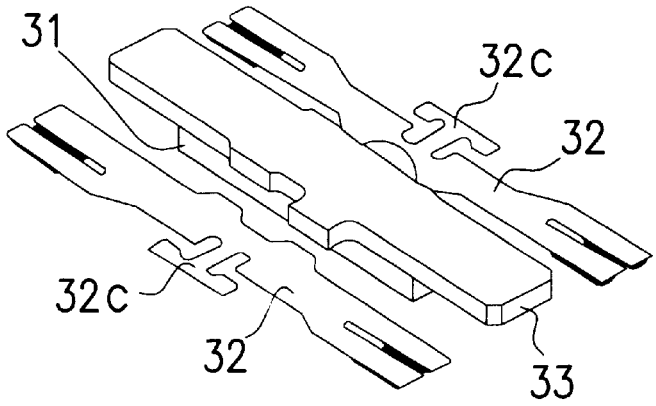
FIG. 10(*a*) is a perspective drawing of the movable block as seen from above before it is resin-molded.
Figure 10B:
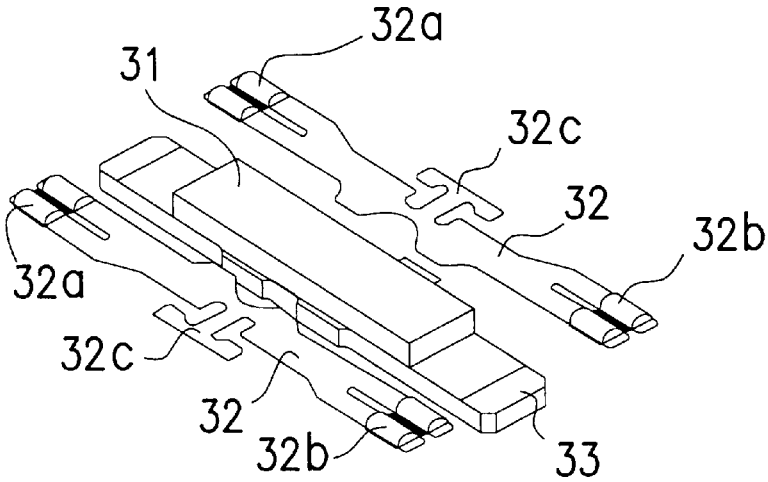

Movable block 30, as illustrated in FIGS. 10(*a*) and 10(*b*), has movable contact elements 32 arrayed in parallel on either side of permanent magnet 31. Movable iron member 33 is laid atop one of the surfaces of the permanent magnet 31, and isolation platform 34 is formed of molded resin in a way that it is integral to the iron member (see FIG. 11).

The permanent magnet 31 is narrower than movable iron member 33 and is placed on the so-called "roll off side" of member 33. Placing the permanent magnet 31 on the roll off side of member 33 prevents any space between the magnet and the member which would impede proper contact between them, unlikely placing the permanent magnet 31 on the burr which might occur when member 33 is subject to the pressing process.

When the edges of the contacting surfaces of permanent magnet 31 and movable iron member 33 have been temporarily immobilized, the two may be resin-molded together. The two pieces may be temporarily anchored in any number of ways: they may be laser-welded; welded with a gas burner; spot-welded; or a thin metal film may be melted on the two surfaces to be joined. A variety of metals may be used for this film, including elemental nickel, zinc, cadmium, tin, copper, chrome, lead, silver, gold, palladium, or their alloys. The thin film may be formed by any of various methods known in the prior art, including plating, vapor deposition or slushing. The thin film may be applied to the entire surface to be joined, or only the edges or the center may be treated. The thin film may be melted by irradiating it with a laser, by heating it with a gas burner or by heating it via electrical resistance.

Movable contact elements 32 are formed by stamping a thin plate of conductive spring material. The ends of each element are bifurcated along the axial line. Two movable contacts 32*a* are placed on one of the bifurcated ends, and two contacts 32*b* are placed on the opposite ends. In the center of each movable contact element 32 is a T-shaped connector 32*c* which extends out to the side.

Movable block 30 may be formed in the following way. After movable contacts 32*a* and 32*b* have been attached, movable contact elements 32, which have been cut out of a lead frame (not shown) in a pressing process, are positioned in a mold. Permanent magnet 31 and movable iron member 33, temporarily anchored together, are also positioned in the mold. These components are then secured to isolation platform 34, formed of molded resin, in a way as to be integral to the platform.

On the movable iron member 33, it is recommended that, except the portions of the member which come in contact with poles 11*a* and 11*b* of core 11, the entire surface be coated with molded resin to improve the isolation characteristics. In this embodiment of the electromagnetic relay, the gap between movable contact elements 32 and movable iron member 33 measures approximately 0.9 mm.

When movable block 30 is positioned onto the base block 20 and bosses 26*a* and 26*b* on the upper surface of base block 20 engage in depressions 34*a* and 34*b* (see FIG. 2) on the lower surface of isolation platform 34, the components are automatically placed into their proper positions. When connectors 32*c* on the movable contact elements 32 are welded to portions 21*a* of common terminals 21, movable block 30 is supported in a way that it can rotate.

In this embodiment of the invention, bosses 26*a* and 26*b* on base block 20 engage in depressions 34*a* and 34*b* on the lower surface of isolation platform 34 to support movable block 30. If the distance between bosses 26*a* and 26*b* should vary due to processing tolerance, then this variation will be absorbed by the bosses themselves because boss 26*b* has a shorter ridge line than boss 26*a*. This feature prevents faulty operation of the relay caused by variations attributable to processing tolerance.

The portions of depressions 34*a* and 34*b* in isolation platform 34 and bosses 26*a* and 26*b* on base block 20 which come in contact with each other are placed on the same plane as connectors 32*c*, which function as the rotating shaft. This insures that the movable member will not wobble due to misposition of the rotating shaft so that the rotation will be smooth.

In the above embodiment of the invention, two bosses 26*a* and 26*b* were provided. The invention is not limited to this case, however. A single boss or more than two bosses could also be provided. Similarly, the shape of the bosses is not limited to that described above. Their tops could also be triangular, conical or hemispherical. It is acceptable that the tops of bosses 26*a* and 26*b* be acutely angled and the bottoms of depressions 34*a* and 34*b* be obtusely angled. This makes it unlikely for the rotational fulcrum to wobble.

Figure 11:
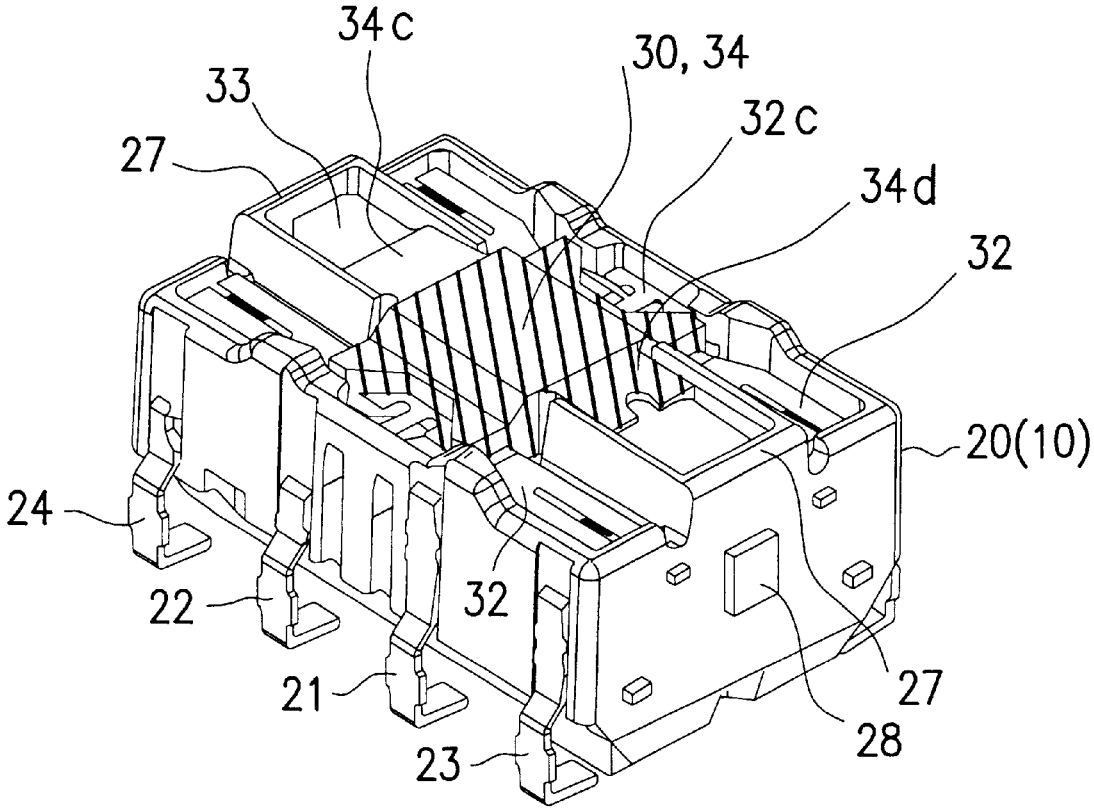
FIG. 11 is a perspective drawing of the electromagnetic relay when the movable block has been mounted to the base block.

Referring now to FIG. 11, when movable block 30 is mounted on base block 20, the angular C-shaped isolation walls 27 segregate movable iron members 33 from movable contact elements 32. The spatial distance between movable iron members 33 and movable contact elements 32 is approximately 9 mm. This configuration of placing the walls 27 between the movable iron members 33 and the movable contact elements 32 results in a longer creepage distance between the surfaces of the two components, thus resulting in good isolation characteristics.

The end portions 34*c* and 34*d* of isolation platform 34 are extended so that they overlap isolation walls 27. This allows a longer creepage distance between the surfaces of the two components, further improving the isolation characteristics.

Figure 13:
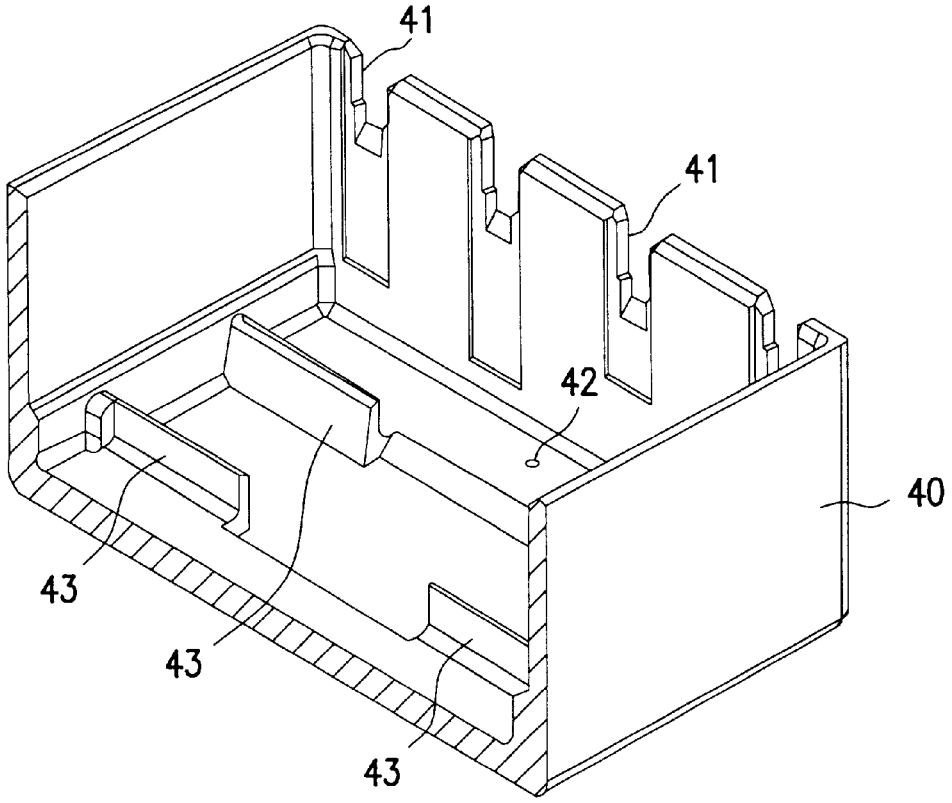
FIG. 13 is a perspective drawing of the case, which has been turned upside down and partially cut away.
Figure 14:
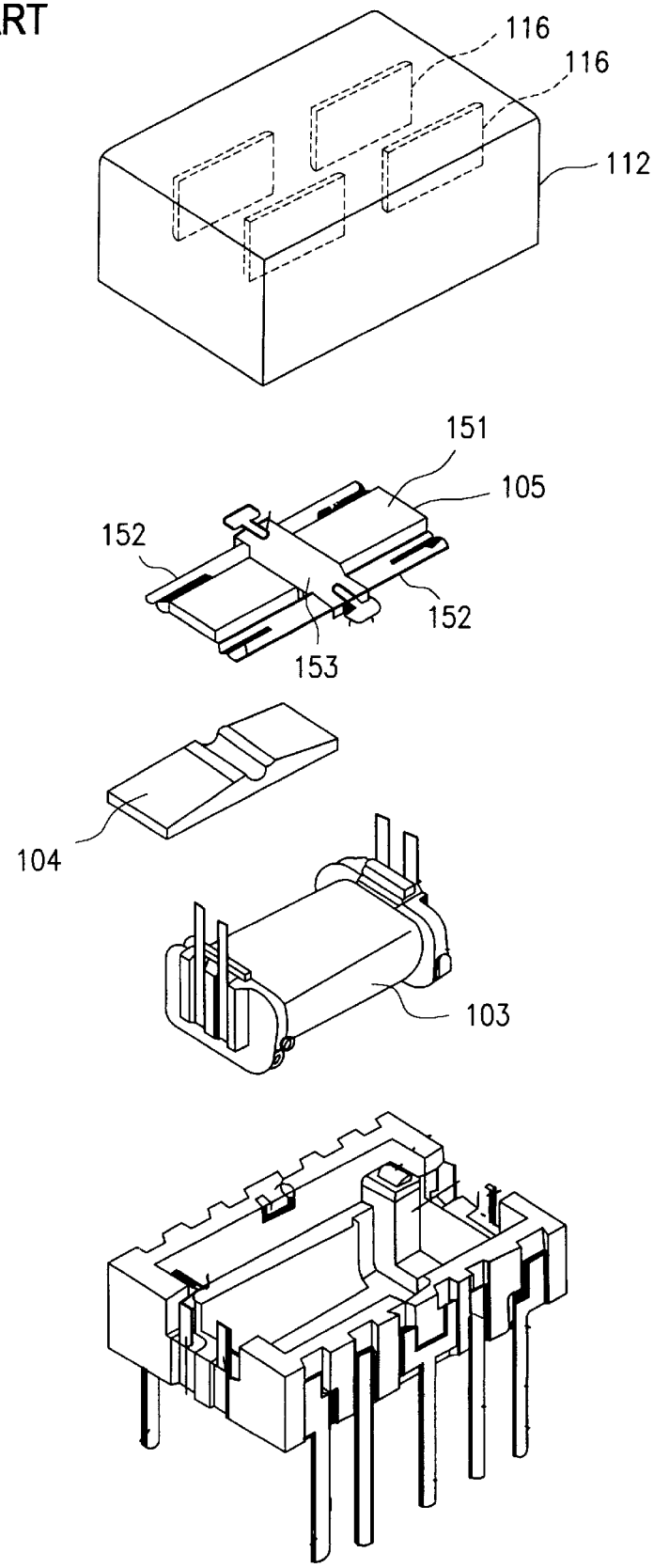
FIG. 14 PRIOR ART
FIG. 14 shows a prior art electromagnetic relay.

Referring back to FIG. 1, case 40 is a box-like cover which engages with base block 20. Cut-away portions 41 along the open edge of the case serve to attach it to the base block. Case 40 also has a hole on the edge of its upper surface through which gas can be removed. Referring to FIG. 13, a number of ribs 43 are provided on the ceiling of case 40. These ribs 43 project downward from the ceiling of case 40. A surface of each of the ribs 43 which comes in contact with one of outer isolation walls 27 on base block 20 is tapered.

Figure 4:
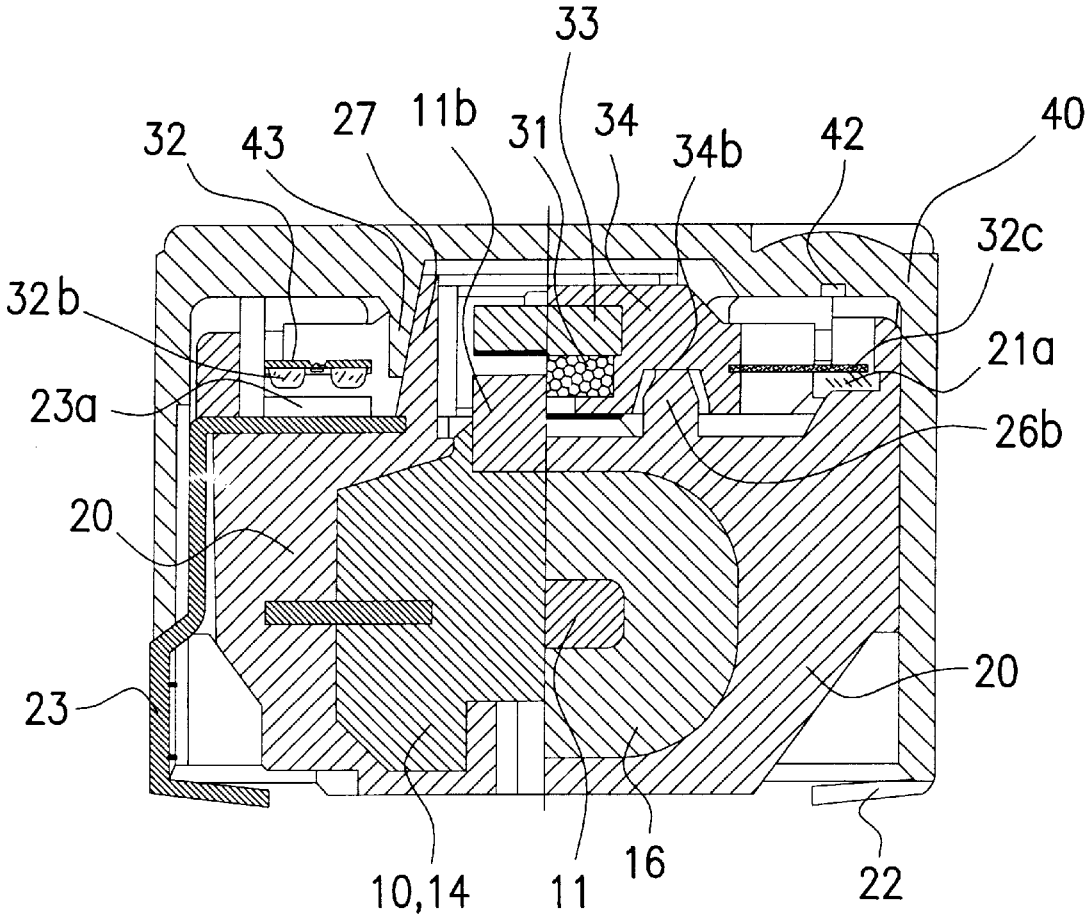
FIG. 4 is a lateral cross section of the electromagnetic relay shown in FIG. 3(*a*).

Case 40 is mounted to base block 20, to which movable block 30 has already been attached. The terminals 21 through 24 engage in cut-away portions 41. Referring to FIG. 4, isolation ribs 43 on case 40 come up against the outer surfaces of isolation walls 27 on the base block 20. This increases the creepage distance between the surfaces of the two components and, therefore, improves the isolation characteristics. These isolation ribs 43 are extending from the inner wall of case 40 continuously. The edges of isolation walls 27 and ribs 43 which come into contact with each other are tapered so that they fit smoothly and are easy to assemble.

Ribs 43 may also be located so as to come up against the inner surfaces of isolation walls 27.

When the adjoining surfaces of base block 20 and case 40 have been sealed, all gases are removed from the interior of case 40 via hole 42, and the hole 42 is sealed with resin. The assembly process is now complete.

The operation of the electromagnetic relay having the configuration described above will now be described.

When no voltage is applied to coil 16 in electromagnetic block 10, the magnetic force generated by the flux in permanent magnet 31 causes the end 33*a* of movable iron member 33 to be attracted to magnetic pole 11*a* of core 11.

When voltage is applied to coil 16 in the electromagnetic block 10 so as to generate a magnetic flux which negates the flux of permanent magnet 31, movable iron member 33 rotates in the opposite direction of the magnetic force of magnet 31; and movable contact element 32 rotates with it. This causes movable contacts 32*a* to move away from fixed contacts 22*a*, and movable contacts 32*b* to approach and touch fixed contacts 23*a*. The other end, 33*b*, of movable iron member 33 is attracted to pole 11*b* of core 11. When the voltage is no longer applied, the magnetic force of permanent magnet 31 will keep movable block 30 in this state.

When an inverse voltage (to the above voltage) is applied to coil 16, movable iron member 33 will rotate in the direction opposite that described above, that is, against the magnetic force of permanent magnet 31; and movable contact element 32 will rotate with it. Movable contacts 32*b* will separate from fixed contacts 23*a*, and movable contacts 32*a* will come in contact with fixed contacts 22*a*. End 33*a* of movable iron member 33 will be attracted to pole 11*a* of core 11, and the relay will return to its original state.

Although the embodiment of the electromagnetic relay discussed above is a locking type, the invention is by no means limited to this form only. It could as well be applied in a resetting type of electromagnetic relay.

As should be clear from the above discussion, the electromagnetic device of this invention has four L-shaped walls for isolating the ends of the movable iron member. Also, the ends of the isolation platform on the movable block extend far enough to overlap the walls. This design provides an electromagnetic relay with a longer creepage distance than prior art relays and, as a result, provides better isolation characteristics.

In another embodiment of this invention, isolation ribs are provided on the ceiling of the case which meet the surfaces of the walls. There is thus no linear gap between the partitions and the ceiling of the case. The creepage distance is increased and the isolation characteristics are further improved.

In yet another embodiment of this invention, the contacting surfaces of either the partitions, the ribs or both are tapered. This prevents the ribs from getting hung up on the partitions when the case is assembled. As a result, the relay can be assembled more smoothly, and the assembly task is further simplified.

In yet another embodiment of this invention, the greater part of the movable iron member is coated with a resin material to boost isolation characteristics.

While the invention has been described with reference to a preferred embodiment and variations thereof, it should be apparent to those skilled in the art that many modifications and variations are possible without departure from the scope and spirit if this invention as defined in the appended claims.

What is claimed is:

1. An electromagnetic relay comprising a base block, a movable block positioned on the base block and comprising a movable iron member and a movable contact member, a case mounted on the base block and an electrical isolation apparatus comprising:

an isolation wall protruding upward from an upper surface of the base block for isolating the movable iron member and the movable contact member, wherein the isolation wall is an L-shaped wall;

an isolation platform on the movable block for integrally forming a central portion of the movable iron member and the movable contact member and for overlapping a surface of the isolation wall; and an isolation rib in the case, said isolation rib contacting said isolation wall.

2. An electromagnetic relay according to claim 1, wherein a contacting surface of either said isolation rib or said L-shaped wall is tapered.

3. An electromagnetic relay according to claim 1, wherein said movable block is coated with a resin material except for ends of said movable iron member which come in contact with said two magnetic poles on said ends of said core.

* * * * *